US005590857A

United States Patent [19]

Albrecht et al.

[11] Patent Number: 5,590,857

[45] Date of Patent: Jan. 7, 1997

[54] TRAILING DEVICE FOR A RAILROAD SWITCH LAYOUT

[75] Inventors: Harry A. Albrecht, Hobe Sound, Fla.; Daniel W. Van Alstine, Rochester, N.Y.

[73] Assignee: General Railway Signal Corporation, Rochester, N.Y.

[21] Appl. No.: 293,242

[22] Filed: Aug. 19, 1994

[51] Int. Cl.[6] ..... E01B 7/02

[52] U.S. Cl. ..... 246/318; 246/452

[58] Field of Search ..... 246/318, 319, 246/320, 321, 449, 450, 452; 74/110

[56] References Cited

U.S. PATENT DOCUMENTS

| | | | |
|---|---|---|---|
| 1,136,767 | 4/1915 | Bossert | 246/452 |
| 1,710,335 | 4/1929 | Anderson | 246/321 |
| 2,468,024 | 4/1949 | Blythe | 246/321 |
| 4,842,225 | 6/1989 | Carmes | 246/452 |
| 4,927,273 | 5/1990 | Mottate | 384/43 |

FOREIGN PATENT DOCUMENTS

| | | | |
|---|---|---|---|
| 214826 | 5/1924 | United Kingdom | 246/452 |

*Primary Examiner*—S. Joseph Morano

*Attorney, Agent, or Firm*—Ohlandt, Greeley, Ruggiero & Perle

[57] ABSTRACT

Apparatus for operating railroad switches, including operation in the trailing mode, and a switch machine having a throw bar and throw rod for enabling the throwing of switch points into selected positions so as to control the switching of rolling stock. A trailing device, including a trailing rod portion of the throw rod, is coupled to the throw bar, said device including an arrangement responsive to a wrong direction load impressed on said switch points so as to move said throw rod, for enabling non-damaging movement of said throw rod.

3 Claims, 3 Drawing Sheets

TRAILING DEVICE FOR A RAILROAD SWITCH LAYOUT

RELATED APPLICATIONS

Reference may be made to co-pending application (Ser. No. 08/293,121 entitled, "Low Profile Switching Machine", now U.S. Pat. No. 5,494,242, assigned to the assignee of the present invention. Also, reference may be made to co-pending applications (Ser. No. 08/293.126, entitled, "Point Detection and Indication with Latch Out Means") and (Ser. No. 08/293,127, entitled "Switch Machine Cam Bar") that are related to the present application and are commonly owned by applicant's assignee.

BACKGROUND OF THE INVENTION

It is a requirement for operation of a railroad to be able to switch trains from one track to another. A common method of providing the switching capability is to install an electric motor driven switch which functions, by means of a motor driven throw bar or the like to throw switch points so as to control the switching of rolling stock.

Although this type of switching works well for main line and transit operations, for yard applications additional switching features are required. For example, it is common for yard switch machines to have provisions for hand throw to permit local operational personnel to operate the switch.

In the context of operation in very busy railroad yards, in which the railroad stock is being continuously moved in the forward and reverse directions, it is required to move such stock through switches with the switch in the reverse or trailing position. A yard switch machine that will trail without damage is very desirable in that the train operator does not have to stop the train and throw the switch is passage if in the reverse or trailing direction.

For a switch machine with trailing capability, passage of rolling stock through the switch in the reverse or trailing direction will cause the switch to be thrown automatically, that is, without the time delay of a manual switch operation.

However, the traditional or conventional method of providing trailing capability for a switch machine has been to package the required mechanism inside the switch machine. This concept is not desirable for the following reasons: (1) The trailing mechanism is rather large and, as a result, packaging the device inside the switch machine results in either a relatively large profile height for the switch or elimination of other desired switch machine functions. (2) A switch machine with a built in trailing means or mechanism cannot be used for main line and transit operations where trailing is not required. (3) The trailing mechanism, according to conventional construction, has such mechanism built into and integral with a switch machine and is usually packaged on the bottom of the machine to be near the throw bar. Consequently, maintenance and inspection is difficult since the switch machine must be disassembled to reach the interior area occupied by the trailing mechanism.

Accordingly, it is a primary object of the present invention to provide a trailing mechanism that can be used in conjunction with a low profile configuration switch machine. A related object of the present invention is to make the aforesaid trailing mechanism such that it can be placed outside the switch machine configuration.

An ancillary object is to provide flexibility so one can either conjoin the trailing mechanism with the switch machine or not so conjoin. In other words the switch machine stands on its own or can either incorporate or not incorporate the trailing mechanism.

A desirable function of a switch machine or a railroad switch layout is the ability to incorporate lost motion into the trailing mechanism. Switch machines are fixed stroke, or fixed throw mechanisms; they are usually set to the maximum throw that will be required for all switch layouts. A throw of 6.0 inches to 6.5 inches maximum is usually selected. Some switch layouts will require much less throw for the switch layout. A 4.0 inch minimum is common in the industry. Since the traditional switch machine is a fixed throw device set for the maximum throw required, a lost motion means must be provided by either the switch machine or the switch layout itself.

It has been the common practice in the industry to provide the lost motion mechanism in the switch layout and not in the switch machine. This practice results in additional installation cost and maintenance of the lost motion mechanism.

It is therefore, an object of another, different feature of the invention to avoid the additional costs normally involved in installation and maintenance of the lost motion mechanism by, instead, incorporating that mechanism within the trailing mechanism or device.

SUMMARY OF THE INVENTION

It will thus be appreciated that if the purpose of the present invention is to provide a novel arrangement for a switch machine that has the feature of a main line switch layout that may be readily converted to a switch machine with trailing capability by the addition of a retro-fitted trailing module in accordance with the present invention. This trailing module is added to the switch machine or the switch layout simply by means of external bolts, such that the module gives the switch layout trailing capability without the need for replacing or making internal structural modifications to the switch machine.

Briefly defined then, the present invention involves an apparatus for operating railroad switches, including operation in a trailing mode, the arrangement being such that a switch machine has a throw bar for enabling the throwing of switch points that control the switching of rolling stock. The machine also has a throw rod, the throw bar and rod being variably extensively coupled such that when a "wrong direction" load is impressed on the switch points, the throw rod will be moved, but there will not be corresponding movement of the throw bar, and hence no damage will be caused to the motor and other components, take-up space being provided in the trailing mechanism.

Other and further objects, advantages and features of the present invention will be understood by reference to the following specification in conjunction with the annexed drawings, wherein like pans have been given like numbers.

DESCRIPTION OF PREFERRED EMBODIMENT

Figure 1A:
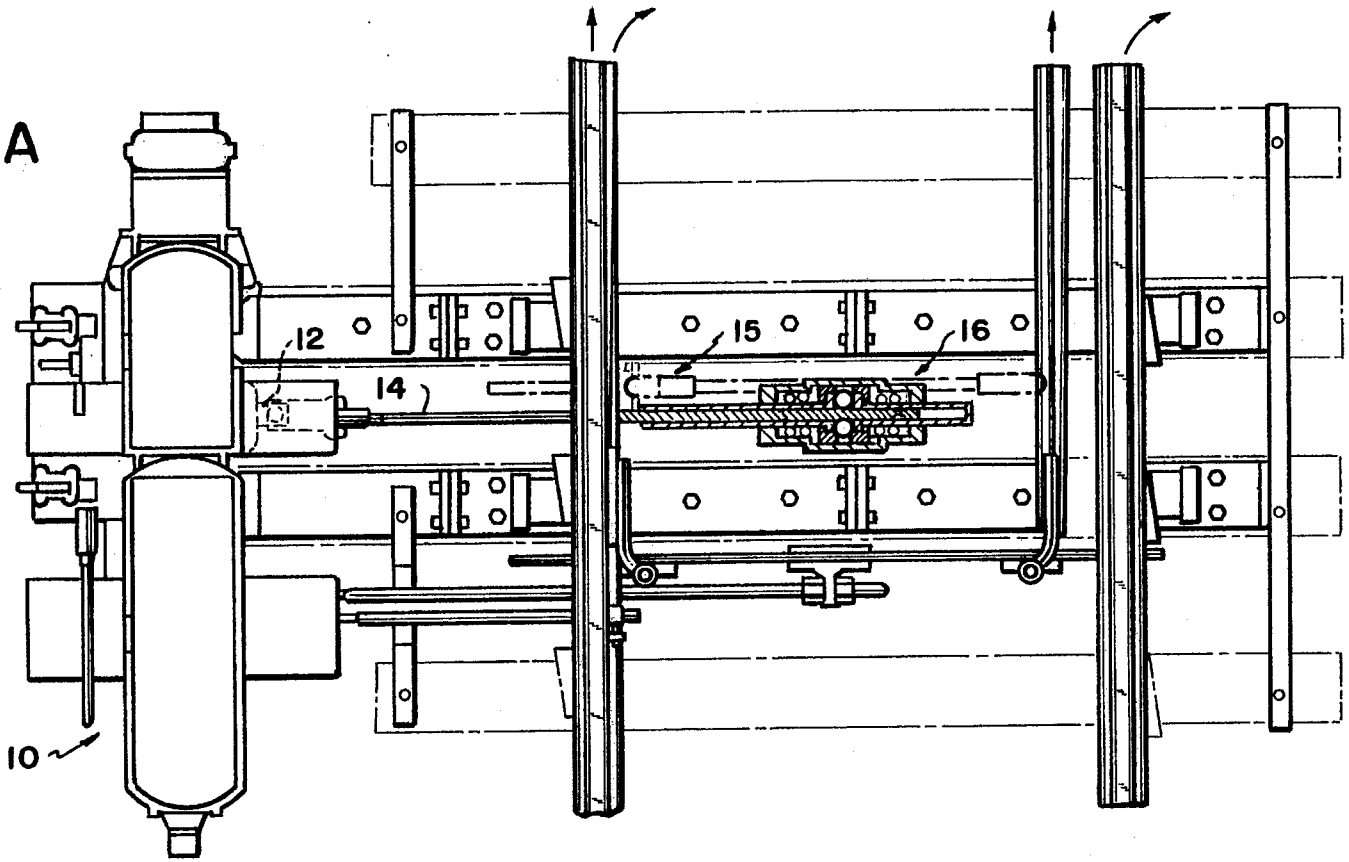
FIG. 1A is a plan view of an exemplary switch layout, particularly illustrating a conventional switch machine connected to an embodiment of the trailing mechanism of the present invention, located as seen.
Figure 1B:
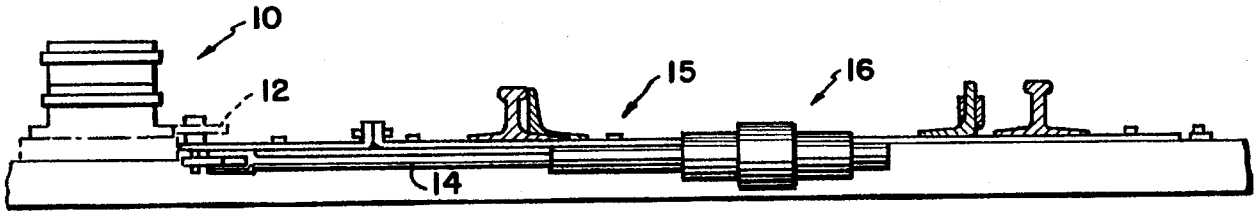
FIG. 1B is an elevation view of the same layout seen in FIG. 1A.

Referring now to the Figures of the drawing and, in particular, to the FIGS. 1A and 1B, there is shown the general layout, i.e., a switch layout with a first embodiment of the trailing device or mechanism located between rails.

As is well understood, a switch machine 10 is located adjacent a railroad track. A throw bar 12 extends from one side of the switch machine, being operative in conventional fashion to initiate the throwing of conventional switch points. Also seen is a throw rod 14 coupled to the throw bar 12 for extending to the switch points. In the embodiment seen in FIG. 1A, a sync bar 16 makes actual connection to the switch points, being bolted to the throw rod 14, and the trailing mechanism 16. In the embodiment seen in FIGS. 1A and 1B, the throw rod 14 extends into and forms an integral part of the trailing mechanism 16, such part being referred to as a trailing rod 22.

Figure 2:
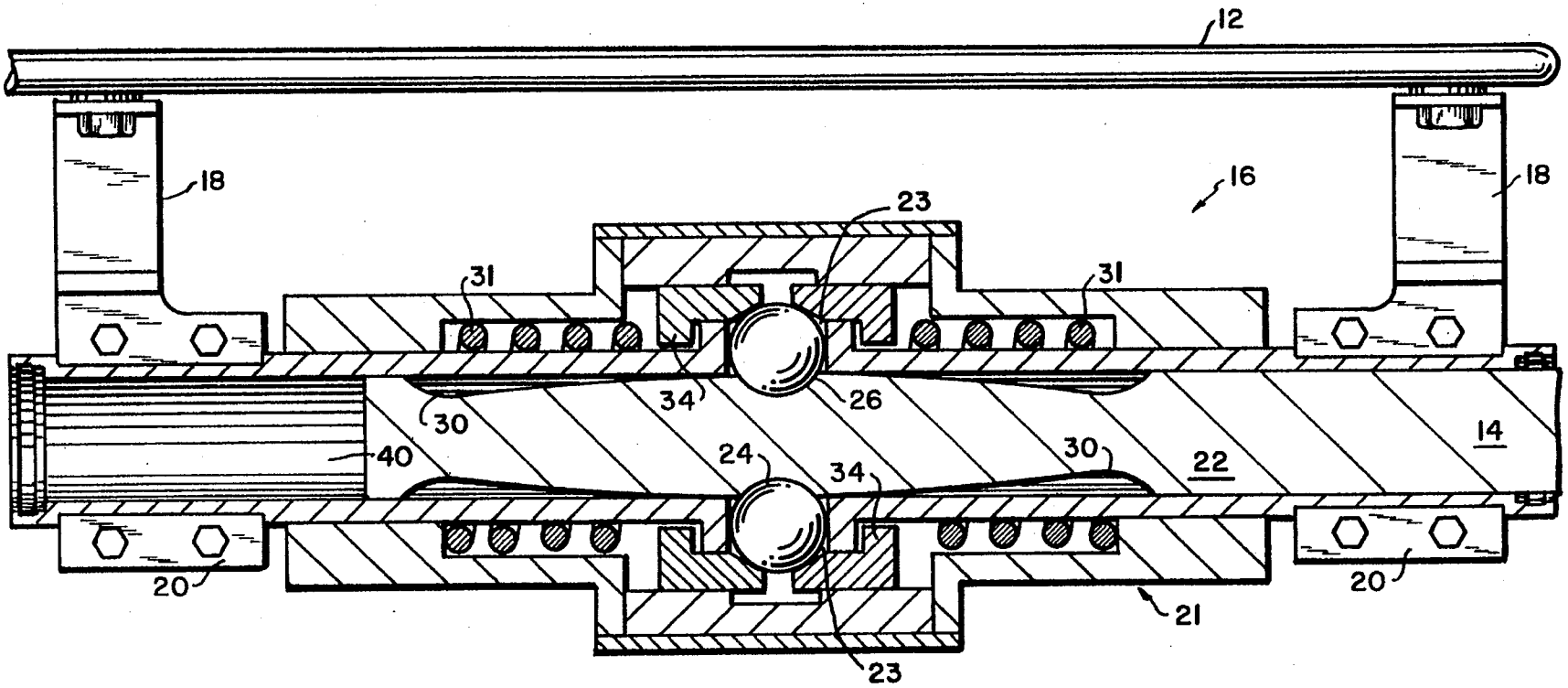
FIG. 2 is a vertical sectional view of another embodiment of the trailing mechanism.

The detailed construction of the trailing mechanism will be described now with reference to FIG. 2, in which an alternate embodiment thereof is provided which is adapted to be slung under the switch machine 14. As seen in FIG. 2, this embodiment of the trailing mechanism 16 is mounted at either end of the switch machine throw bar 12, by means of mounting brackets 18 and mounting clamps 20.

The trailing mechanism 16 is contained within a housing 21 and also enclosed within the housing is the trailing rod 22 which engages with or forms part of the throw rod 14. The trailing rod 22 is configured to have a generally cylindrical shape but to provide a pocket or pockets 23 to retain or detain ball means in the form of first and second balls, 24 and 26, as seen; although, additional balls would be optionally included. The ball means acts to center the trailing rod relative to the trailing device housing. A cam surface or cam surfaces 30 are machined on either side of each pocket to provide trailing operation. Inside the housing are two compression springs 31, one on either side, and ball retainers 34 on either side of the balls. The springs are compressed to center the trailing or throw rod and to preset the desired trailing force.

The normal position of each of the balls, relative to the cam surfaces 30, is in the middle pocket or detent 23. As the switch machine throw bar 12 moves the switch points from normal to reverse without trailing, the trailing device or mechanism 16 is non-operational and the ball means remains in the middle of the cam arrangement.

However, to illustrate a trailing mode, consider the following: with the switch machine throw bar 12 extended to the right, let us assume that a piece of rolling stock produces a left directional load into the trailing mechanism as shown. That is to say, a rolling stock piece proceeds in a "wrong direction"against the setting of the switch points.

What would normally happen in such a situation without the trailing mechanism is that the load, having a force of 1500 lbs. or greater, would have its way; that is, the switch points would be forced in the opposite direction with attendant movement of the throw rod and consequent reverse movement of the parts of the switch machine. Particularly in the event that the motor driver is in a non-operating state, severe damage could result to the motor and many of the components of the switch machine.

However, in the assumed case, that is, with the trailing mechanism as seen in FIG. 2 functioning properly, the effect is that the "left load" causes the trailing rod 22 to be moved to the left and ball means to end up out of its normal position in pocket or detent 23, and into the right curved cam surface 30, responsive to this left ward movement of the trailing rod 22 of the trailing mechanism. However, with the space available within the housing on the left hand, that is, the space 40, the trailing rod portion or section 22 is free to so move without moving the throw bar 12. Thus, the switch is thrown back to its opposite position without damage to the equipment. The switch will then remain in this position until the switch machine throw bar is thrown to the left position. Since the rail point is already in the left throw position, it bottoms on the stock rail. When the throw bar load exceeds the roller retention load, the trailing bar will be pulled out or extended and the ball means 24 will snap into the normal position, i.e., into detent or pocket 23.

By inspection, it is clear that the reverse mode of operation is possible. Likewise, it is clear that the position of the trailing device relative to the switch machine may be rotated 180°, if it is desired to install the switch machine on the opposite side of the tracks. As noted previously, another option for installation of the trailing mechanism is to mount such device as seen in FIGS. 1A and 1B, that is, between the stock rails as seen therein. In this mode, the trailing mechanism housing is mounted on the sync bar 15 between the switch points; the throw rod is extended out to attach to the throw bar of the switch machine as shown.

As noted previously, for the present type of installation of the invention of this trailing device, some lost motion must be incorporated in the system to make up for the difference between the switch throw that is required and the switch machine throw. As will be seen in FIG. 3, the ball slot detent or pocket 32 in the trailing device throw rod can be adjusted from a no lost motion position to 2.5 inches of lost motion. Such a configuration combines both the advantages of the trailing mechanism, as well as the lost motion function incorporated in the same device, which lost motion function is required for this type of switch installation.

Figure 3:
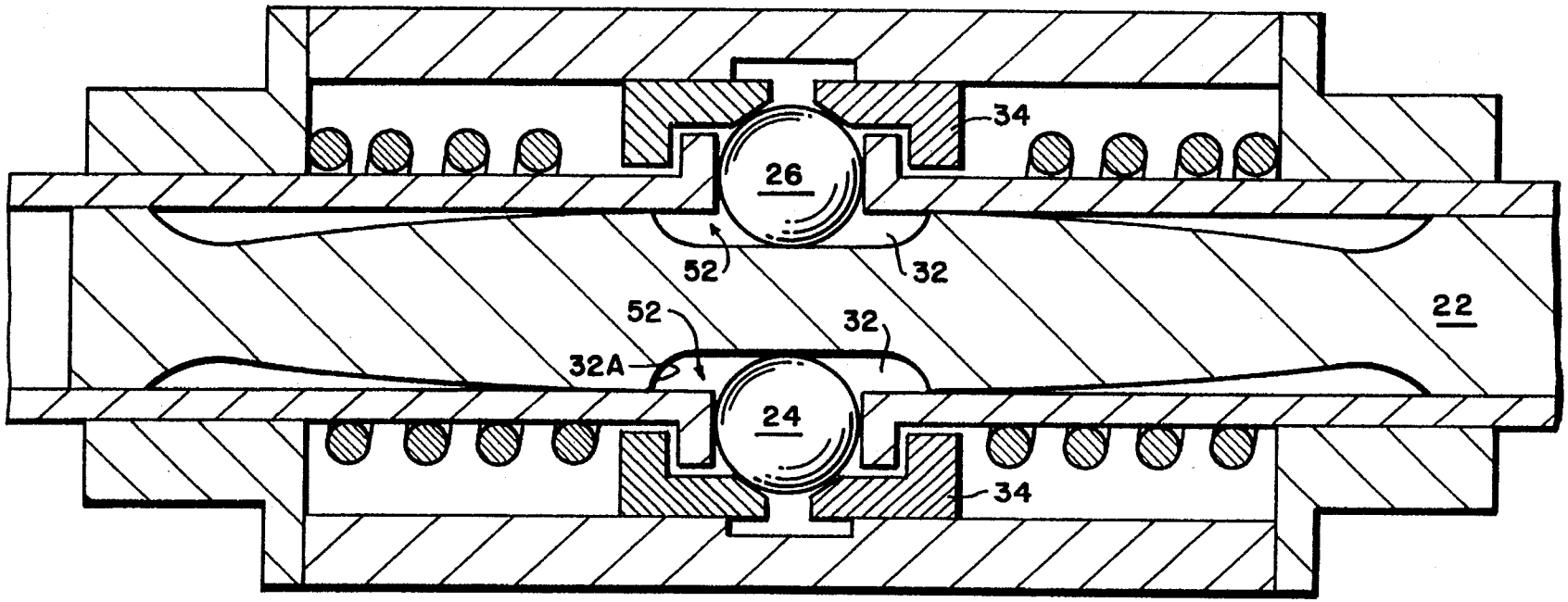
FIG. 3 is a view of the lost motion means incorporated within the trailing mechanism so as to provide adjustability in making the switch throw compatible with the switch machine throw.

Referring now to FIG. 3, there is shown a fragmentary view of a modified form of trailing mechanism which is essentially the same as the mechanism 16, shown in FIG. 2. However, herein the lost motion means 52 is incorporated within the trailing mechanism 16 already described. Instead of the ball means 24 being disposed in the limited pocket 23, as seen in FIG. 2, the ball means is disposed in a much extended pocket or pockets 32, such that only when the sloping cam surfaces 32A of the pockets 32 contact the ball means 24, is it forced against the retainer means 34 such that the trailing rod 22 can move as already described.

The invention having been thus described with particular reference to the preferred forms thereof, it will be obvious that various changes and modifications may be made therein without departing from the spirit and scope of the invention as defined in the appended claims.

We claim:

1. Apparatus for operating railroad switches, having switch points, including operation in a trailing mode, comprising:

a throw rod, and a housing in which said throw rod is encased;

a switch machine, having a throw bar fixedly coupled to the housing for said throw rod, for enabling the throwing of said switch points into selected positions so as to control the switching of rolling stock;

a trailing device, including means for providing coupling of said throw bar with said throw rod, and for selectively enabling de-coupling thereof responsive to a wrong direction load impressed on said switch points, in which said means includes a bore with take-up space in said housing, said throw rod being movable in the bore relative to the throw bar; ball means which are immovable axially, pockets formed in said throw rod for normally receiving the ball means, and curved cam surfaces in the throw rod on either side of the respective pockets for receiving the ball means in the trailing mode.

2. Apparatus defined in claim 1 in which said ball means includes a plurality of balls spaced around the throw rod.

3. Apparatus as defined in claim 2, further including retainer means for retaining said ball means, and spring means for biasing the retainer means against the ball means to set the trailing force.

* * * * *